US008108969B2

(12) United States Patent
Ochiai

(10) Patent No.: US 8,108,969 B2
(45) Date of Patent: Feb. 7, 2012

(54) CHECKER-EQUIPPED DOOR HINGE DEVICE FOR VEHICLE

(75) Inventor: Manabu Ochiai, Saitama (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 313 days.

(21) Appl. No.: 12/174,117

(22) Filed: Jul. 16, 2008

(65) Prior Publication Data

US 2009/0133222 A1 May 28, 2009

(30) Foreign Application Priority Data

Jul. 20, 2007 (JP) ..... 2007-190019

(51) Int. Cl.
*E05D 11/10* (2006.01)

(52) U.S. Cl. ..... 16/334; 16/82; 16/342

(58) Field of Classification Search ..... 16/347, 16/334, 321, 82, 342, 85, 49, 54, 50; 296/146.9, 296/146.11
See application file for complete search history.

(56) References Cited

U.S. PATENT DOCUMENTS 5,452,501 A * 9/1995 Kramer et al. ..... 16/334
5,867,869 A * 2/1999 Garrett et al. ..... 16/252
6,213,881 B1 * 4/2001 Sasa et al. ..... 16/50
6,481,055 B2 * 11/2002 Cheng ..... 16/252
6,481,056 B1 * 11/2002 Jesse ..... 16/334
6,609,273 B1 * 8/2003 Yamada et al. ..... 16/332
6,766,561 B1 * 7/2004 Cheng ..... 16/235
7,188,390 B2 * 3/2007 Cheng ..... 16/252
2007/0136993 A1 * 6/2007 Ishii et al. ..... 16/334

* cited by examiner

*Primary Examiner* — Victor Batson
*Assistant Examiner* — Jeffrey O Brien
(74) *Attorney, Agent, or Firm* — Arent Fox LLP

(57) ABSTRACT

A checker-equipped door hinge device for vehicle includes: a first bracket fixed to one of a body and a door; a second bracket fixed to another one of the body and the door; a hinge pin connecting the first and second brackets to each other, and allowing the brackets to be relatively rotatable; an inner cylinder connected integrally to the first bracket and disposed coaxially with the hinge pin; an outer cylinder connected integrally to the second bracket and disposed so as to surround the inner cylinder in a manner of being rotatable relative to the inner cylinder; and a checking-force generating mechanism provided between the inner cylinder and the outer cylinder, the checking-force generating mechanism generating a checking force against the door at a predetermined opening position of the door, wherein an inner peripheral surface and an outer peripheral surface of the outer cylinder are eccentric to each other, so that a thick wall portion having a large distance between the inner peripheral surface and the outer peripheral surface is formed in the outer cylinder, and the checking-force generating mechanism is provided in the thick wall portion. Thereby the door hinge device can be compact, in which the checking-force generating mechanism can be disposed in the outer cylinder without increasing the diameter of the outer cylinder.

3 Claims, 11 Drawing Sheets

DOOR CLOSED STATE

DOOR FULLY OPENED STATE

CHECKER-EQUIPPED DOOR HINGE DEVICE FOR VEHICLE

CROSS REFERENCE TO RELATED APPLICATION

This application claims the priority of Japanese Application No. 2007-190019, filed Jul. 20, 2007, the entire specification, claims and drawings of which are incorporated herewith by reference.

BACKGROUND OF THE INVENTION

1. Field of the Invention

The present invention relates to a vehicle door hinge device that supports a door for opening and closing a door opening or a tail gate of an automobile or the like, specifically, a checker-equipped door hinge device for vehicle, comprising: a first bracket fixed to one of a body and a door; a second bracket fixed to another one of the body and the door; a hinge pin connecting the first and second brackets to each other, and allowing the brackets to be relatively rotatable; an inner cylinder connected integrally to the first bracket and disposed coaxially with the hinge pin; an outer cylinder connected integrally to the second bracket and disposed so as to surround the inner cylinder in a manner of being rotatable relative to the inner cylinder; and a checking-force generating mechanism provided between the inner cylinder and the outer cylinder, the checking-force generating mechanism generating a checking force against the door at a predetermined opening position for the door.

2. Description of the Related Art

Such checker-equipped door hinge device for vehicle has already been known as disclosed in the specification of U.S. Pat. No. 6,481,056.

In the conventional checker-equipped door hinge device for vehicle, a checking-force generating mechanism includes a retainer, detent rollers, a coil spring, a plurality of detent grooves. The retainer is attached to an outer cylinder, and rotates along with the outer cylinder. The detent rollers are supported by the retainer, and capable of rolling on the outer peripheral surface of the inner cylinder. The coil spring is wound around the detent rollers and generates an elastic recoil force in the radial direction to urge each of the detent rollers towards the outer peripheral surface of the inner cylinder. The detent grooves are provided in the outer peripheral surface of the inner cylinder so as to be arranged at intervals in the circumferential direction while extending in the axial direction of the inner cylinder. The detent rollers are engaged with, and disengaged from, the detent grooves in association with the relative rotations of the inner cylinder and the outer cylinder. In any cases, in such conventional checker-equipped door hinge device for vehicle, since the checking-force generating mechanism is provided between the inner cylinder and the outer cylinder, across the circumferences of these cylinders, the entire diameter of the checker-equipped door hinge device is inevitably increased. As a result, a problem may possibly occur that such door hinge device is difficult to arrange in a narrow and small space between the body and the door of an automobile.

SUMMARY OF THE INVENTION

The present invention has been made in view of the above circumstances, and it is an object thereof to provide a compact checker-equipped door hinge device for vehicle, in which a checking-force generating mechanism can be disposed in an outer cylinder without the diameter of the outer cylinder being particularly increased.

In order to achieve the object, according to a first feature of the present invention, there is provided a checker-equipped door hinge device for vehicle, comprising: a first bracket fixed to one of a body and a door; a second bracket fixed to another one of the body and the door; a hinge pin connecting the first and second brackets to each other, and allowing the brackets to be relatively rotatable; an inner cylinder connected integrally to the first bracket and disposed coaxially with the hinge pin; an outer cylinder connected integrally to the second bracket and disposed so as to surround the inner cylinder in a manner of being rotatable relative to the inner cylinder; and a checking-force generating mechanism provided between the inner cylinder and the outer cylinder, the checking-force generating mechanism generating a checking force against the door at a predetermined opening position for the door, wherein an inner peripheral surface and an outer peripheral surface of the outer cylinder are eccentric to each other, so that a thick wall portion having a large distance between the inner peripheral surface and the outer peripheral surface is formed in the outer cylinder, and the checking-force generating mechanism is provided in the thick wall portion of the outer cylinder.

With the first feature of the present invention, the inner peripheral surface and the outer peripheral surface of the outer cylinder are eccentric to each other, and the checking-force generating mechanism is provided in the thick wall portion, having the large distance between the inner peripheral surface and the outer peripheral surface of the outer cylinder, of the outer cylinder. This configuration makes it possible to efficiently arrange the checking-force generating mechanism with a large volume in the outer cylinder without the diameter of the outer cylinder being particularly increased, and thus achieve a compact checker-equipped door hinge device. Accordingly, the checker-equipped door hinge device can be easily arranged even in a narrow and small space between the body and the door.

According to a second feature of the present invention, in addition to the first feature, an attachment concave portion opening towards an outer peripheral surface of the inner cylinder is provided in the thick wall portion, the checking-force generating mechanism is formed of: a holding member supported in the attachment concave portion so as to be capable of advancing and retreating with respect to the outer peripheral surface of the inner cylinder; and an elastic member housed in the attachment concave portion so as to urge the holding member towards the outer peripheral surface of the inner cylinder, a detent projection is provided on the holding member, the detent projection projecting to be abut against the outer peripheral surface of the inner cylinder, and a detent groove is provided in the outer peripheral surface of the inner cylinder, the detent projection being engaged with, and disengaged from, the detent groove in association with the relative rotations of the inner cylinder and the outer cylinder. Note that the detent projection corresponds to detent rollers 26 in a later-described embodiment of the present invention.

With the second feature of the present invention, the checking-force generating mechanism can be easily provided in the thick wall portion of the outer cylinder.

According to a third feature of the present invention, in addition to the second feature, the checker-equipped door hinge device for vehicle further comprises a slider in the inner cylinder, the slider slidably abutting against the inner peripheral surface of a thin wall portion of the outer cylinder, the thin wall portion having a small distance between the inner peripheral surface and the outer peripheral surface.

With the third feature of the present invention, the outer cylinder brings the inner peripheral surface of the thin wall portion into pressure contact with the slider by receiving the compression repulsive force of an elastic member. When the inner cylinder and the outer cylinder relatively rotate, the slider slides with respect to the inner peripheral surface of the thin wall portion side. This configuration makes it possible to desirably adjust the opening and closing feeling of the door by changing the material properties, the surface roughness, the sliding area, and the like, of the slider.

Hereinafter, embodiments of the present invention will be described with reference to preferred embodiments shown in the accompanying drawings.

DESCRIPTION OF THE PREFERRED EMBODIMENTS

Figure 1:
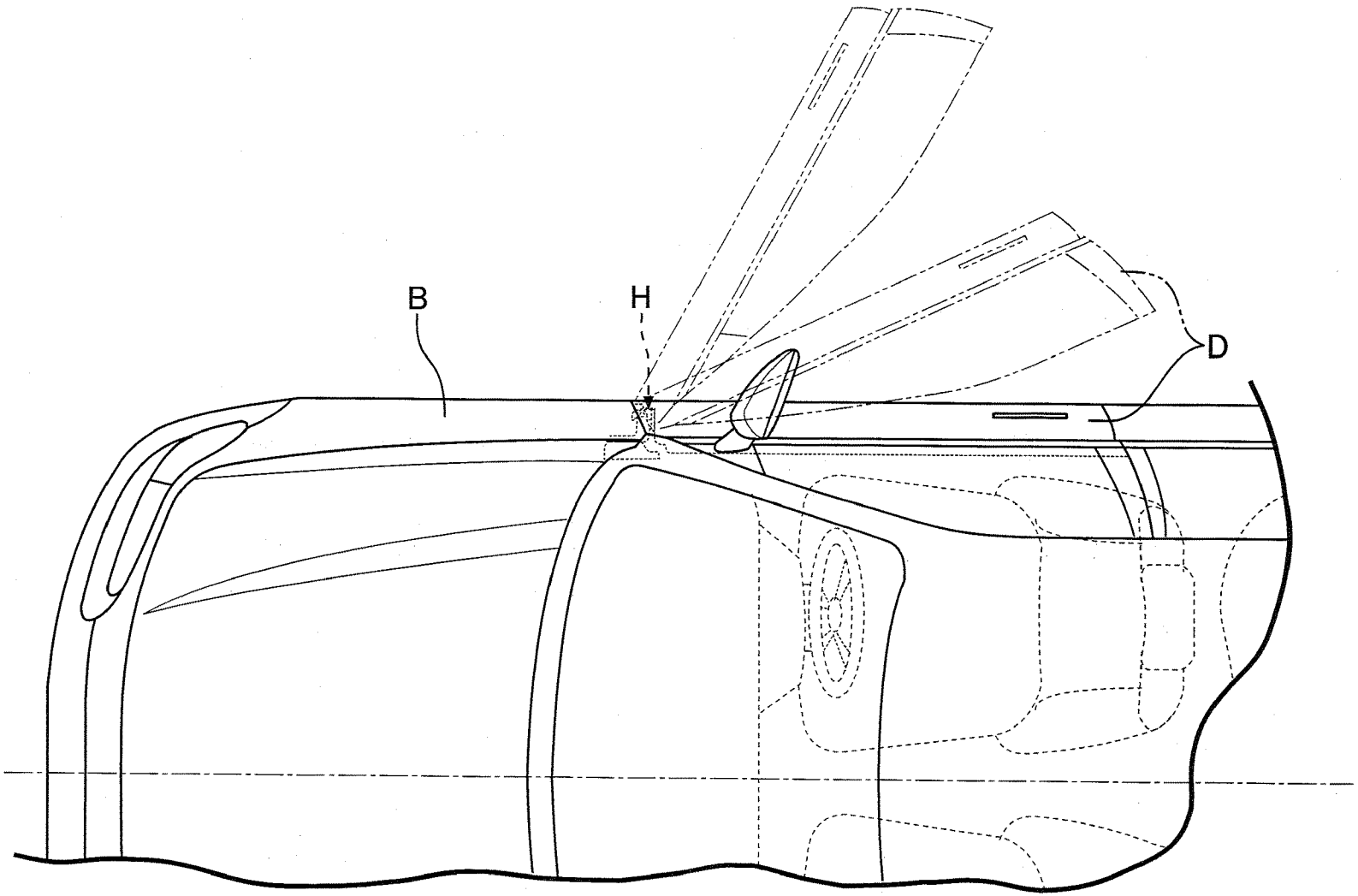
FIG. 1 is a plan view showing an essential part of an automobile including a checker-equipped door hinge device according to a first embodiment of the present invention.

Firstly, the first embodiment of the present invention will be described. In FIG. 1, a door D is rotatably attached to a body B of an automobile with a door hinge device H interposed therebetween so that the door D can open and close the door opening of the automobile.

As shown in FIGS. 2 to 5, the door hinge device H includes: a female bracket 1 fixed to the body B with a plurality of bolts 3; a male bracket 2 fixed to the door D with a plurality of bolts 4; and a hinge pin 5 disposed in a vertical direction to couple these brackets 1 and 2 in a relatively rotatable manner.

The female bracket 1 includes a pair of upper and lower female arm portions 1*a*. A pair of upper and lower male arm portions 2*a* of the male bracket 2 are arranged adjacently on the inner sides of the upper and lower female arm portions 1*a*, respectively. The hinge pin 5 is arranged to vertically penetrate the arm portions 1*a* and 2*a*. The hinge pin 5 is fixed to the female arm portions 1*a* by an enlarged head portion 5*a* on one side of the hinge pin 5 and a riveting portion 5*b* on the other side thereof. An inner cylinder 6 that penetrates the male arm portions 2*a* is fitted on the outer circumference of the hinge pin 5. A positioning projection 8 is provided on each surface of the inner cylinder 6, while a positioning concave portion 9 is provided on a surface, facing the inner cylinder 6, of each of the female arm portions 1*a* (see FIGS. 2 and 7). Opposite end portions of the inner cylinder 6 are integrally connected respectively to the female arm portions 1*a* in a way that each positioning projection 8 and the corresponding positioning concave portion 9 engage with each other. One of the male arm portions 2*a* is rotatably supported on one end portion of the inner cylinder 6 with a first bearing bush 16 interposed in between. The other one of the male arm portions 2*a* is rotatably supported on the other end portion of the inner cylinder 6 with a second bearing bush 16' and a collar 17 interposed in between. The second bearing bush 16' has a diameter larger than that of the first bearing bush 16, and the collar 17 is fitted on the inner peripheral surface of the second bearing bush 16' (see FIGS. 2 and 8).

An outer cylinder 7, which is rotatable relative to the inner cylinder 6, is disposed on the outer circumference of the inner cylinder 6. A first and a second covers 10 and 10' are disposed respectively on opposite ends of the outer cylinder 7. The first and second covers 10 and 10' are rotatably supported respectively on the outer peripheral surfaces of the first and second bearing bushes 16 and 16' while sealing the inside of the outer cylinder 7.

Figure 3:
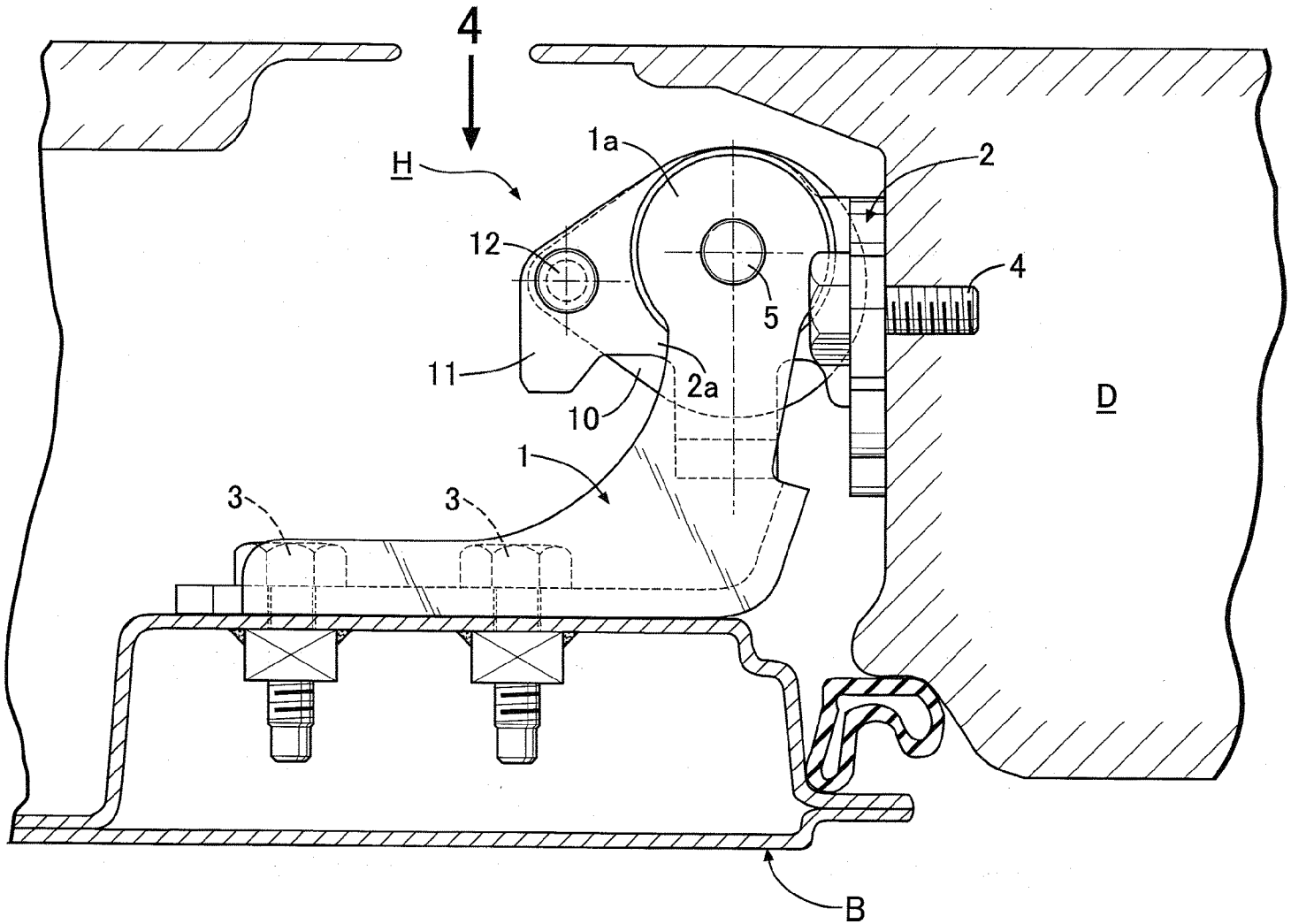
FIG. 3 is a plan view showing the checker-equipped door hinge device in a state where a door is closed.
Figure 4:
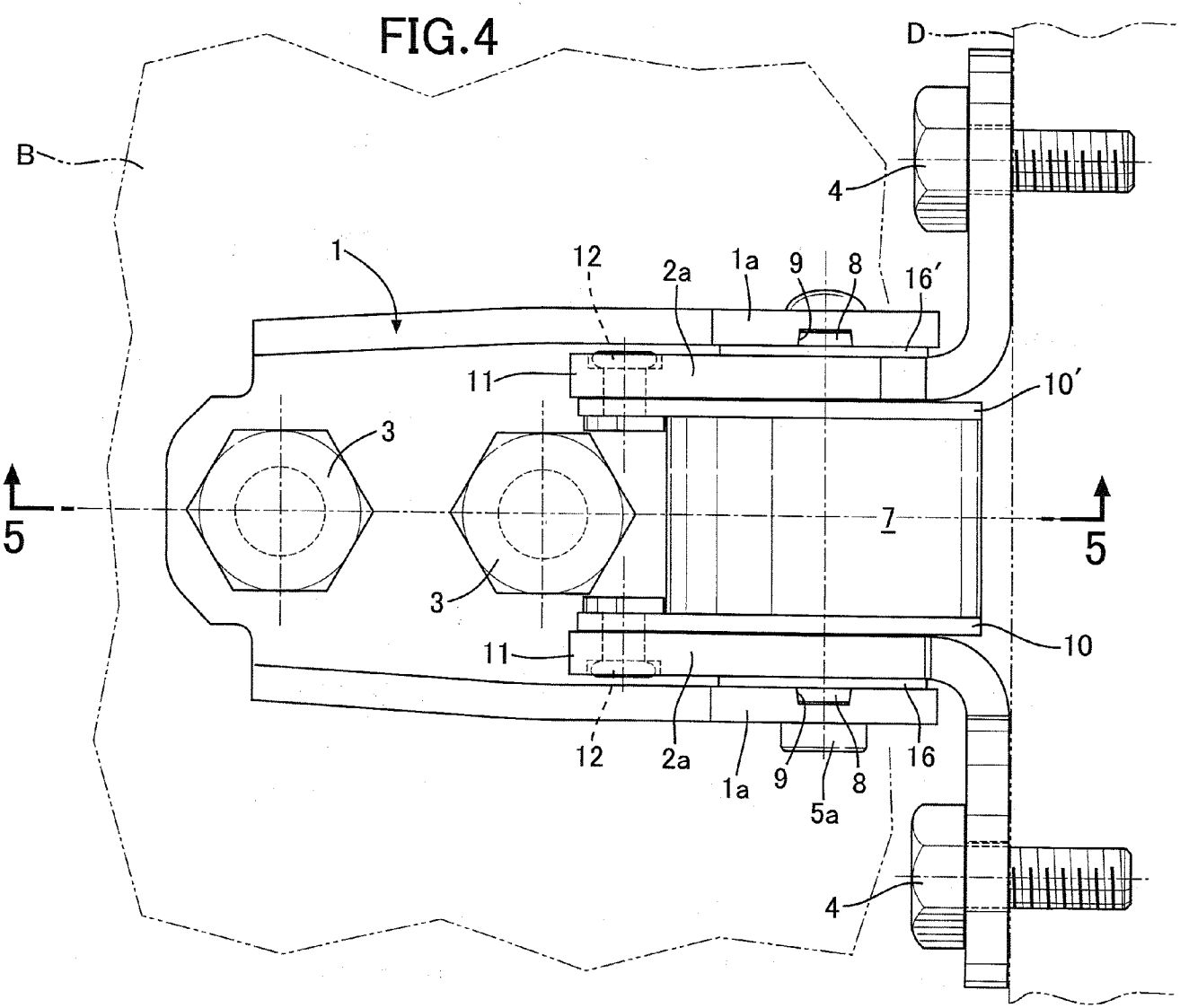
FIG. 4 is a view in the direction of an arrow 4 in FIG. 3.
Figure 9:
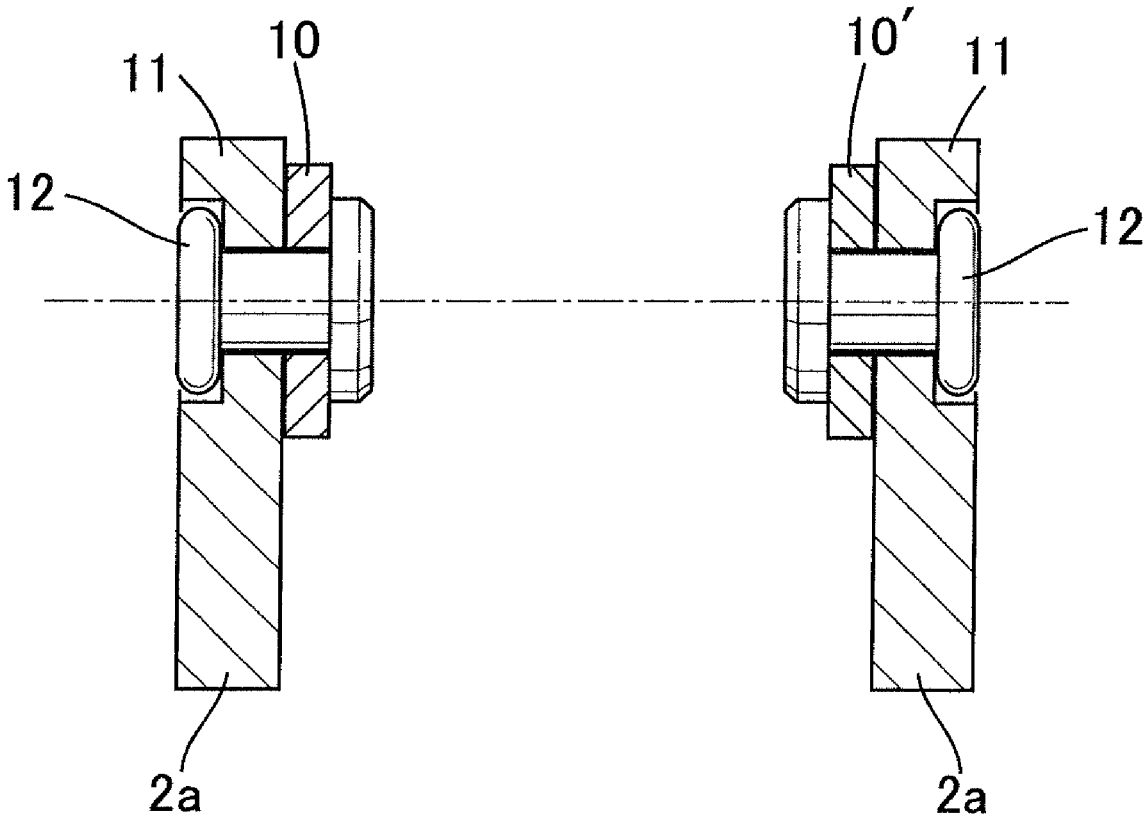
FIG. 9 is a cross-sectional view taken along a line 9-9 in FIG. 5.

As shown in FIGS. 3 and 9, each of the male arm portions 2*a* integrally has an ear portion 11 protruding in the radial direction. The covers 10, 10' are fixed to these ear portions 11 with rivets 12, respectively. In addition, each of these covers 10, 10' has, on its inner side surface, a circular connecting projection 14 that is concentric with the outer peripheral surface of the outer cylinder 7, in other words, eccentric to the inner peripheral surface of the outer cylinder 7. The connecting projections 14 are fitted respectively on the end surfaces of the outer cylinder 7, so that each of the first and second covers 10 and 10' and the outer cylinder 7 are connected to one another so as to be integrally rotatable.

Figure 6:
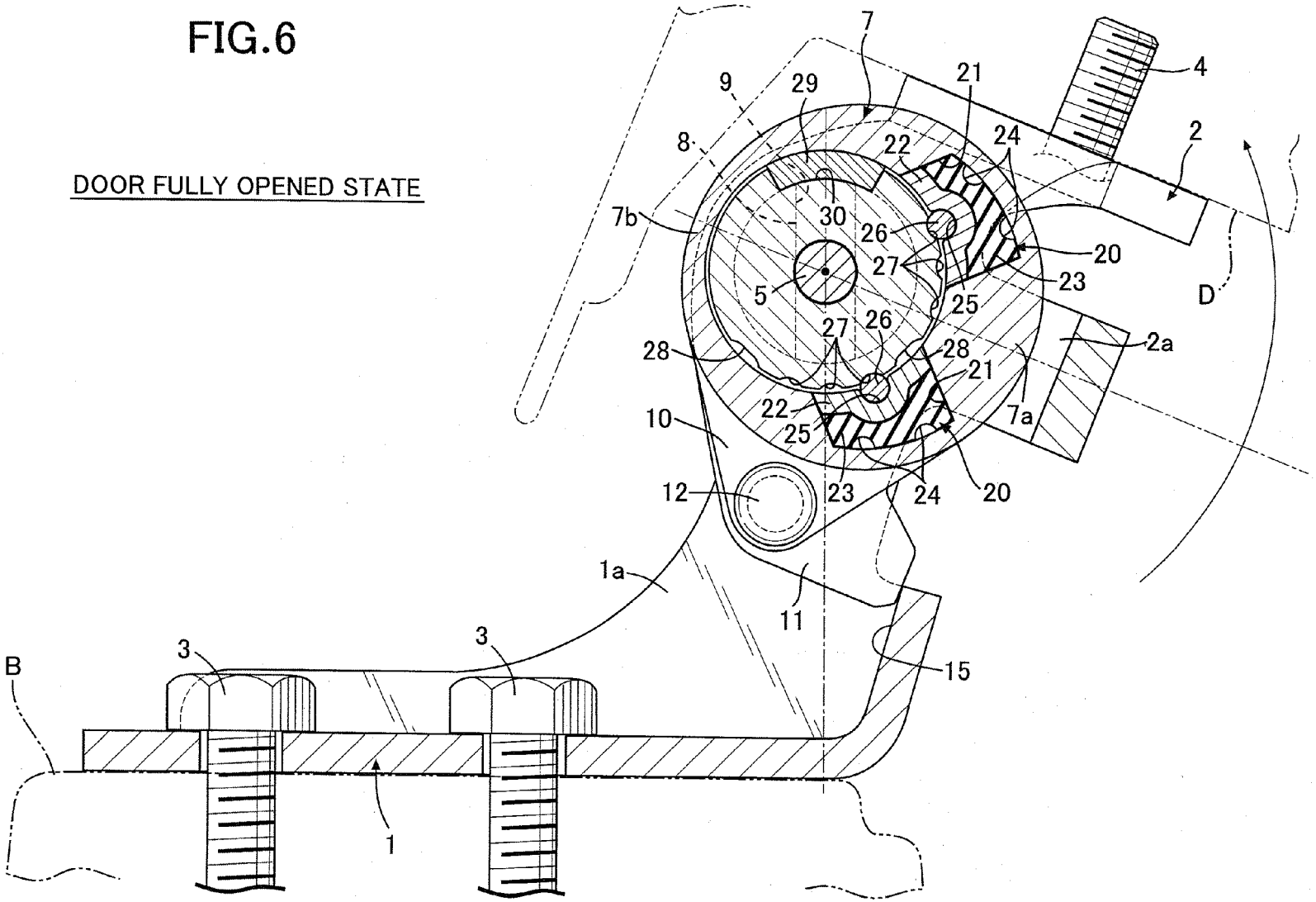
FIG. 6 is a view corresponding to FIG. 5 and showing the checker-equipped door hinge device in a state where the door is fully opened.

As shown in FIG. 6, a stopper wall 15 is formed integrally in the female bracket 1. The stopper wall 15 restricts a fully opening position for the door D in a way that the ear portions 11 of the male arm portions 2*a* come into contact with the stopper wall 15.

In FIGS. 2, 5 to 7, a checking-force generating mechanism 20 is provided between the inner cylinder 6 and the outer cylinder 7. The checking-force generating mechanism 20 generates a checking force against the door D at a half opening position or the fully opening position for the door D. Hereinafter, the checking-force generating mechanism 20 will be described.

Figure 5:
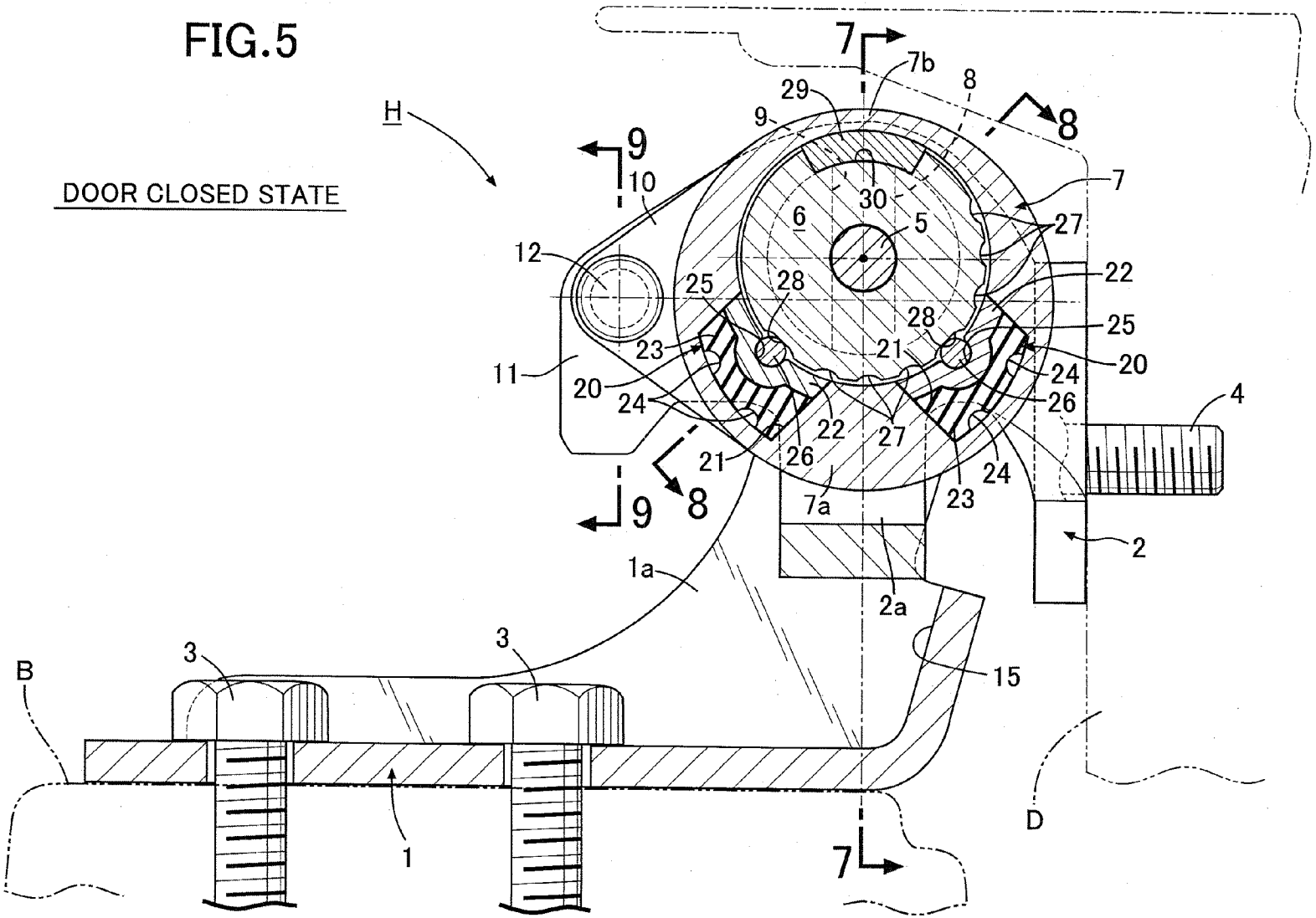
FIG. 5 is a cross-sectional view taken along a line 5-5 in FIG. 4.

As clearly shown in FIG. 5, in the outer cylinder 7, the inner peripheral surface and the outer peripheral surface are eccentric to each other. A semi-circular part of the outer cylinder 7, on a side where the distance between the inner peripheral surface and the outer peripheral surface thereof is large, is defined as a thick wall portion 7*a*, while the other semi-circular part of the outer cylinder 7, on a side where the distance is small, is defined as a thin wall portion 7*b*. One or a plurality of attachment concave portions 21 arranged in the circumferential direction (two in the embodiment shown) are formed in the inner peripheral surface of the thick wall portion 7*a*. Each attachment concave portion 21 is formed in a manner that its inner side surfaces, facing to each other in the circumferential direction of the outer cylinder 7, are parallel to each other. Holding members 22 each having a high rigidity are fitted respectively into the attachment concave portions 21 so as to be slidable in the radial direction of the outer cylinder 7, and elastic members 23 each made of rubber are filled respectively in the attachment concave portions 21 so as to cause the corresponding holding members 22 to be resiliently urged against the inner cylinder 6. Each of the elastic members 23 is provided with recesses or drillings 24 for adjusting the compression modulus of elasticity of the elastic member 23.

A semi-columnar holding groove 25 opening towards the inner cylinder 6 and extending in the axial direction of the outer cylinder 7 is formed in each of the holding members 22. A substantially semi-circular part of a detent roller 26 that is capable of rolling on the outer peripheral surface of the inner cylinder 6 is engaged with and held by each holding groove 25 in a manner that the detent roller 26 is rotatable.

Meanwhile, the outer diameter of an intermediate part, sandwiched by the first and second bearing bushes 16 and 16', of the inner cylinder 6 is smaller than the outer diameter of the second bearing bush 16' but is larger than the inner diameter thereof. A plurality of detent grooves 27 each having a V-shaped cross section and extending in the axial direction of the inner cylinder 6 are provided on the outer peripheral surface of the intermediate part of the inner cylinder 6. Each of the detent rollers 26 is engaged with, and disengaged from, one of the detent grooves 27 in association with the relative rotations of the inner cylinder 6 and the outer cylinder 7.

Each of the detent rollers 26 is engaged with a corresponding one of the detent grooves 27 by means of the elastic force of the corresponding elastic member 23 so as to generate the checking force against the door D. In the case of the embodiment shown in the figures, a set of three detent grooves 27 are provided correspondingly to each of the detent rollers 26 so that the checking force can be generated at the two half opening positions and the fully opening position for the door D. A roller releasing groove 28 having a groove width larger than the detent groove is provided to be adjacent to one side of each set of these detent grooves 27. Each of the roller releasing grooves 28 frees the detent roller 26 when at a closing position for the door D.

The movements of the holding members 22, the elastic members 23, and the detent rollers 26 in the axial direction are restricted by the covers 10, 10' closing the respective opposite ends of the outer cylinder 7.

The checking-force generating mechanism 20 is provided to the thick wall portion 7*a* of the outer cylinder 7 in the above-described manner.

In the above-described configuration, the pressure-receiving area, which receives the pressure from the elastic member 23, of a connecting wall portion 22*b* is set to be sufficiently larger than an area where each detent roller 26 and each detent groove 27 abut against each other.

As shown in FIG. 5, a concave portion 30 is provided at a part, facing the thin wall portion 7*b* of the outer cylinder 7, on the outer peripheral surface of the intermediate part of the inner cylinder 6. A slider 29 slidably abutting against the inner peripheral surface of the outer cylinder 7 is fitted in the concave portion 30.

Next, the operation of this embodiment will be described.

Figure 2:
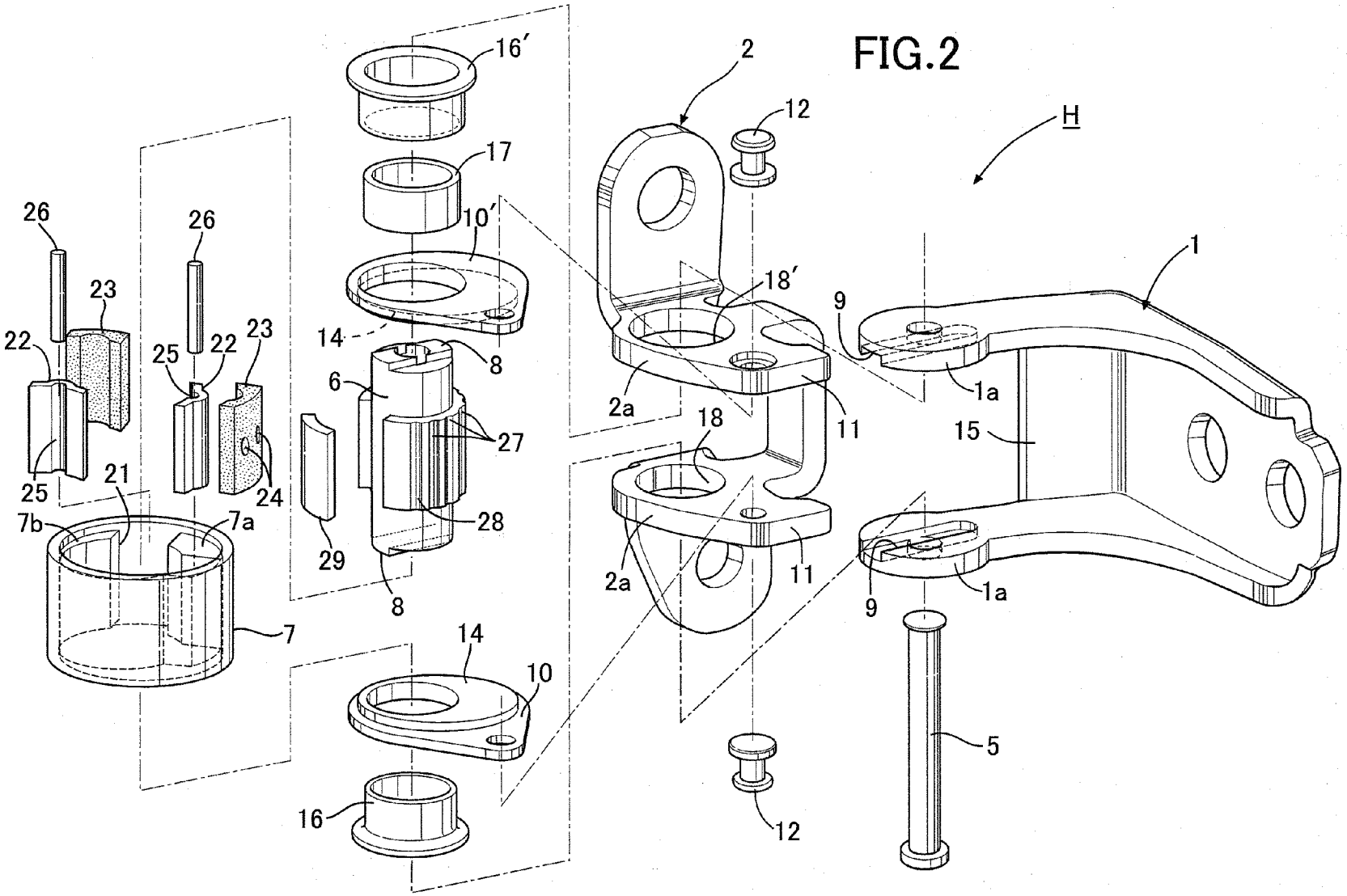
FIG. 2 is an exploded perspective view showing the checker-equipped door hinge device.
Figure 7:
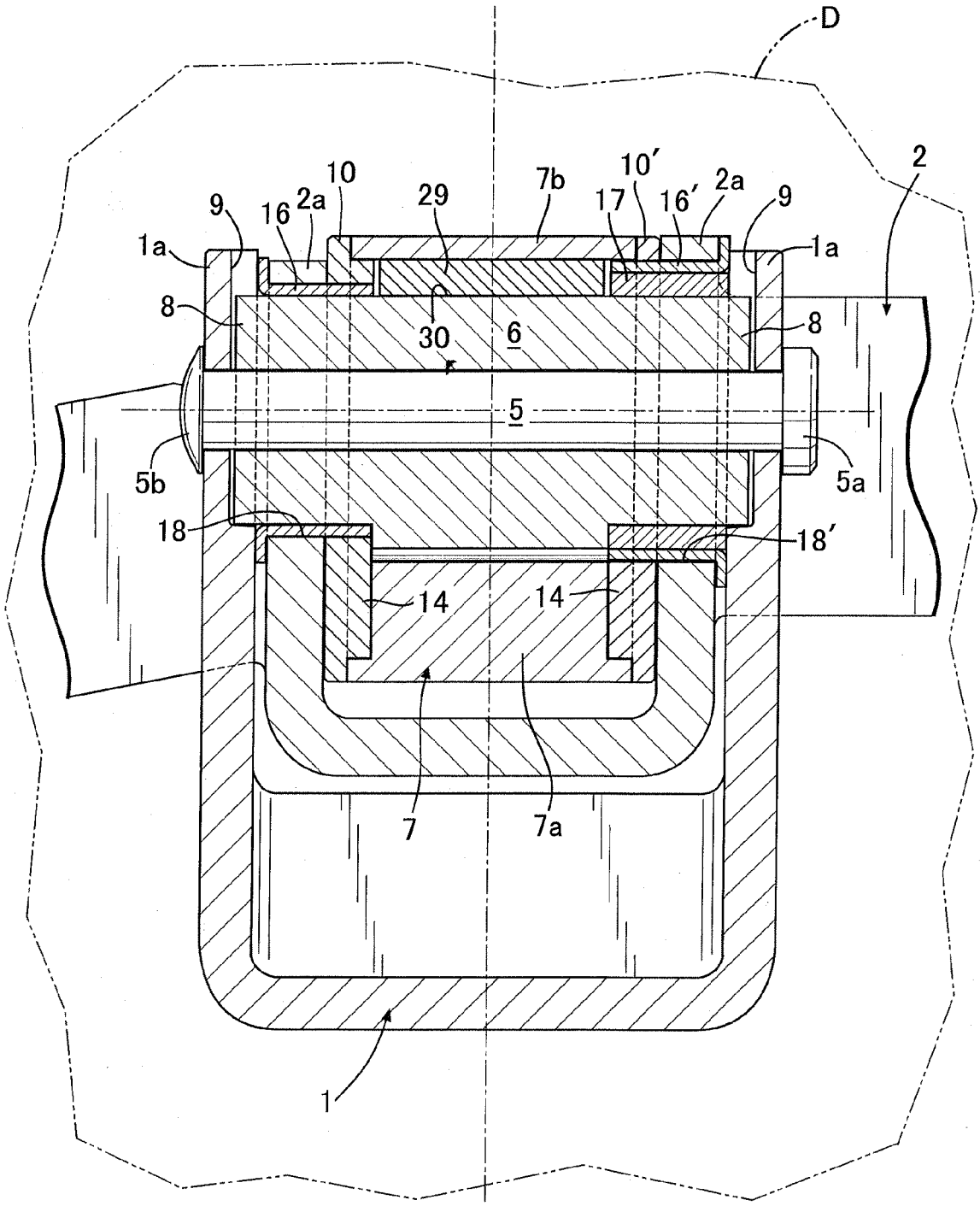
FIG. 7 is a cross-sectional view taken along a line 7-7 in FIG. 5.
Figure 8:
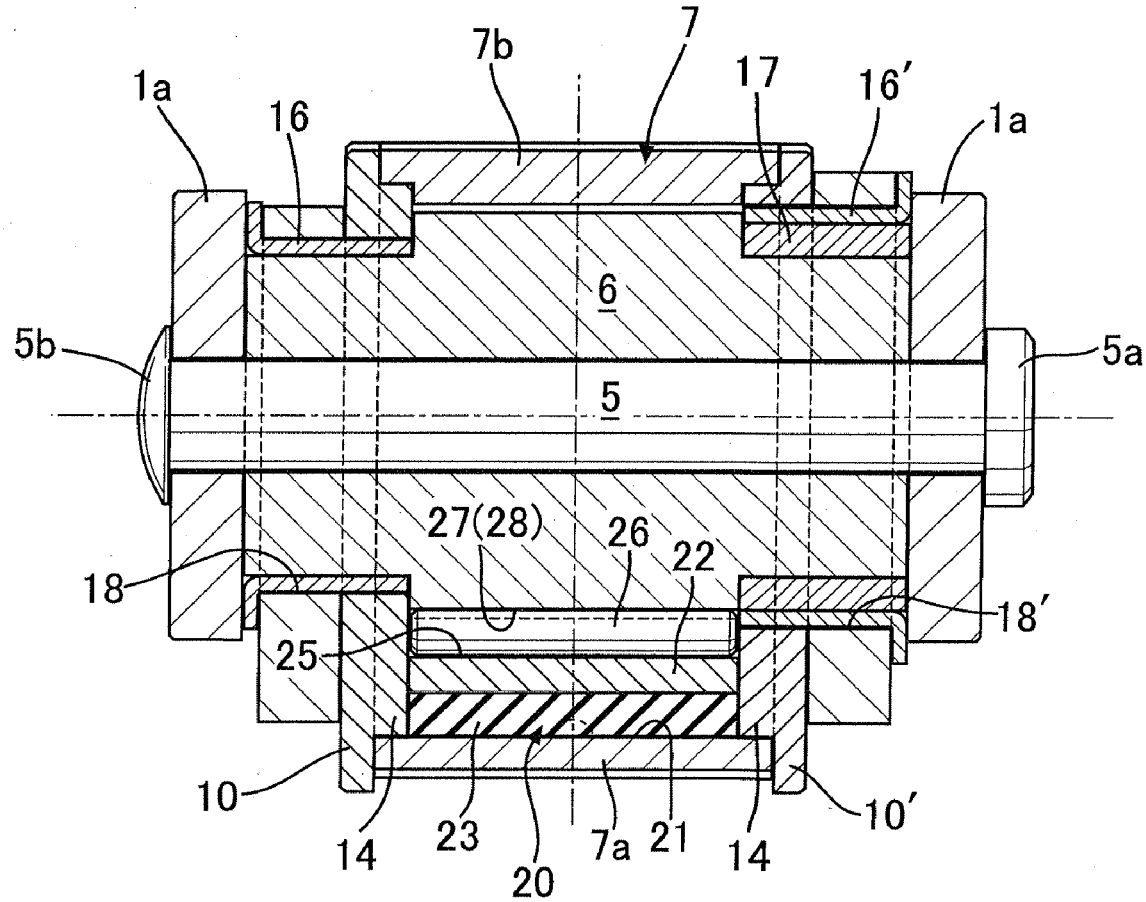
FIG. 8 is a cross-sectional view taken along a line 8-8 in FIG. 5.

The checker-equipped door hinge device H of the present invention will be assembled in the following way. In FIGS. 2 and 7, the inner cylinder 6 and the outer cylinder 7 are firstly fitted to each other while the holding members 22, the elastic members 23, the detent rollers 26, and the slider 29 are installed between the inner cylinder 6 and the outer cylinder 7. Then, the first and second covers 10 and 10' are mounted respectively on opposite end portions of the outer cylinder 7, so that the assembly of the inner cylinder 6 and the outer cylinder 7 is built up.

Subsequently, the first bearing bush 16 is mounted on a first bush hole 18 of one of the male arm portions 2*a*, thereafter, the assembly is inserted into a second bush hole 18' of the other one of the male arm portions 2*a*, and then, one end portion of the inner cylinder 6 is fitted onto the inner peripheral surface of the first bearing bush 16. Thereafter, the second bearing bush 16' is mounted on the second bush hole 18', and the collar 17 is fitted between the inner peripheral surface of the second bearing bush 16' and the outer peripheral surface of the other end of the inner cylinder 6. Then, the first and second covers 10 and 10' are joined to the ear portions 11 of the male arm portions 2*a* with the rivets 12, respectively. As a result, the mounting of the assembly of the inner cylinder 6 and the outer cylinder 7 into the male bracket 2 is completed.

Next, the male bracket 2 is inserted between the pair of female arm portions 1*a* of the female bracket 1, and the positioning projections 8 on opposite end surfaces of the inner cylinder 6 is engaged respectively with the positioning concave portions 9 of the corresponding female arm portions 2*a*. Thereafter, the hinge pin 5 is mounted, so that the assembly of the checker-equipped door hinge device H is completed.

In the mounting of the checker-equipped door hinge device H on an automobile, while the female bracket 1 is fixed to the body B with bolts 3, the male bracket 2 is fixed to the door D with bolts 4.

Thus, when the user rotationally moves the door D between the fully closing position and the fully opening position, the male bracket 2 joined to the door D rotationally moves between the closing position (the state in FIGS. 3 and 5) and the fully opening position (the state in FIG. 6). Accordingly, the outer cylinder 7 connected to the male bracket 2 rotates with respect to the inner cylinder 6 connected to the female bracket 1. The rotation of the outer cylinder 7 simultaneously causes the holding members 22 and the elastic members 23 the two supported in the attachment concave portions 21 to rotate, so that each detent roller 26 held by the holding groove 25 of the holding member 22 moves while rolling on the outer peripheral surface of the inner cylinder 6.

In this event, when the door D is moved to the predetermined half opening position or the fully opening position, each detent roller 26 reaches a position where the detent roller 26 can be engaged with a predetermined one of the detent grooves 27 that corresponds to the position of the door D. Then, the holding member 22 holding the detent roller 26 is caused to slide towards the inner cylinder 6 by the compression repulsive force of the elastic member 23, thus pressing the detent roller 26 into the predetermined detent groove 27.

Meanwhile, when a rotational force is applied to the door D by an external force, the detent roller 26 held by each of the holding members 22 starts to climb up the slope of the detent groove 27 of the inner cylinder 6, in a manner of getting out of the detent groove 27. At this time, upon receiving a pressing force from the detent roller 26, each of the holding members 22 slides in the attachment concave portion 21 outward in the radial direction, thus compressing equally each portion of the elastic member 23 with the entire pressure-receiving surface of the holding member 22. For this reason, the compression ratio at this moment is high enough to thus generate a large compression repulsive force in the elastic member 23. Accordingly, since the pressure-receiving area, which receives the pressure from the elastic member 23, of each holding member 22 is set to be larger than the area where each detent roller 26 and each detent groove 27 abut against each other, the holding member 22 can effectively amplify the pressure applied thereto from the elastic member 23, and thus transmit the amplified pressure to the detent roller 26 and the detent groove 27. It is thus possible to enhance the engaging force of the detent roller 26 and the detent groove 27, and thus, to more effectively enhance the check torque of the door D. As a result, the door D can be prevented from moving freely.

In a case where a plurality of sets of the holding member 22 and the elastic member 23 are arranged in the circumferential direction of the outer cylinder 7, each set of the holding member 22 and the elastic member 23 individually operates. Accordingly, even when some of the elastic members 23 lose their resilient forces for some reason, the other normal elastic members 23 keep pressing the corresponding holding members 22, thus preventing loss of the checking function of the checking-force generating mechanism 20, so that the reliability is enhanced.

In addition, the pressure-receiving area, which receives the pressure from the elastic member 23, of each holding member 22 is set to be larger than the area where each detent roller 26 and each detent groove 27 abut against each other. Accordingly, the surface pressure between each holding member 22 and the corresponding elastic member 23 is sufficiently reduced, so that the wear resistances thereof are improved. Additionally, each holding member 22 can amplify the pressure applied thereto from the elastic member 23, and thus transmit the amplified pressure to the detent roller 26 and the detent groove 27. With this effect, it is possible to enhance the engaging force of the detent roller 26 and the detent groove 27, and thus, to effectively enhance the check torque of the door D.

Moreover, the inner peripheral surface and the outer peripheral surface of the outer cylinder 7 are eccentric to each other. The semi-circular part of the outer cylinder 7, on the side where the distance between the inner peripheral surface and the outer peripheral surface thereof is large, is defined as the thick wall portion 7*a*. The checking-force generating mechanism 20 formed of the holding member 22 and the elastic member 23 is provided in the thick wall portion 7*a*. Accordingly, the checking-force generating mechanism 20 with a large capacity can be efficiently arranged in the outer cylinder without the diameter of the outer cylinder 7 being particularly increased. For this reason, this configuration contributes to achieving a compact checker-equipped door hinge device H. As a result, the checker-equipped door hinge device H can be easily arranged even in a narrow and small space between the body B and the door D.

Furthermore, the other semi-circular part of the outer cylinder 7, on the side where the distance between the inner peripheral surface and the outer peripheral surface thereof is small, is defined as the thin wall portion 7*b*. Then, the slider 29 slidably abutting against the inner peripheral surface of the outer cylinder 7 is fitted in the part, facing the thin wall portion 7*b*, the outer peripheral surface of the inner cylinder 6. The outer cylinder 7 thus receives the compression repulsive force of the elastic member 23 so as to bring the inner peripheral surface of the thin wall portion 7*b* into pressure contact with the slider 29 that is made of a synthetic resin. Accordingly, when the inner cylinder 6 and the outer cylinder 7 relatively rotate, the slider 29 slides with respect to the inner peripheral surface on the thin wall portion 7*b* side. Therefore, it is possible to desirably adjust the opening and closing feeling of the door D by changing the material properties, the surface roughness, the sliding area, or the like, of the slider 29.

In addition, the female bracket 1 is provided with the pair of female arm portions 1*a*, which support opposite end portions of the hinge pin 5, and which are connected to the inner cylinder 6 disposed on the outer periphery of the hinge pin 5. The male bracket 2 is provided with the pair of male arm portions 2*a*, which are arranged adjacently on the inner sides of the female arm portions 1*a*, and which are supported to be relatively rotatable on the outer peripheries of opposite end portions of the inner cylinder 6 with the bearing bushes 16 and 16' interposed in between, respectively. Then, the outer cylinder 7 is connected to, and arranged between, the two of the male arm portions 2*a*. Accordingly, it is possible to arrange the inner cylinder 6, the outer cylinder 7, and the checking-force generating mechanism 20 by effectively utilizing the space between the pair of male arm portions 2*a* arranged between the pair of female arm portions 1*a*. For this reason, this configuration also contributes to achieving a compact checker-equipped door hinge device H.

Still furthermore, the pair of covers 10, 10' are attached to opposite ends of the outer cylinder 7. The pair of covers 10, 10' seal the inside of the outer cylinder 7, and restrict the movements of the detent rollers 26, the holding members 22, and the elastic members 23 in the axial direction. Accordingly, the pair of covers 10, 10' prevent rain water and dust from entering inside the checking-force generating mechanism 20 in the outer cylinder 7, so as to secure the normal function of the checking-force generating mechanism 20 over a long period of time. Additionally, since the covers 10, 10' also function as stopper members that restrict the movements of the detent rollers 26, the holding members 22, and the elastic members 23 in the axial direction, this configuration contributes to reduction in the number of components, and therefore, to the simplification of the structure.

The elastic member 23 made of rubber is filled in each attachment concave portion 21 in a compressed state, and the surface of the elastic member 23 is in close contact with the holding member 22 in a resiliently urged manner. This configuration makes it possible to effectively utilize the space in the attachment concave portion 21 for the filling of the elastic member 23 made of rubber. This configuration also contributes to achieving a compact checker-equipped door hinge device H.

Figure 10:
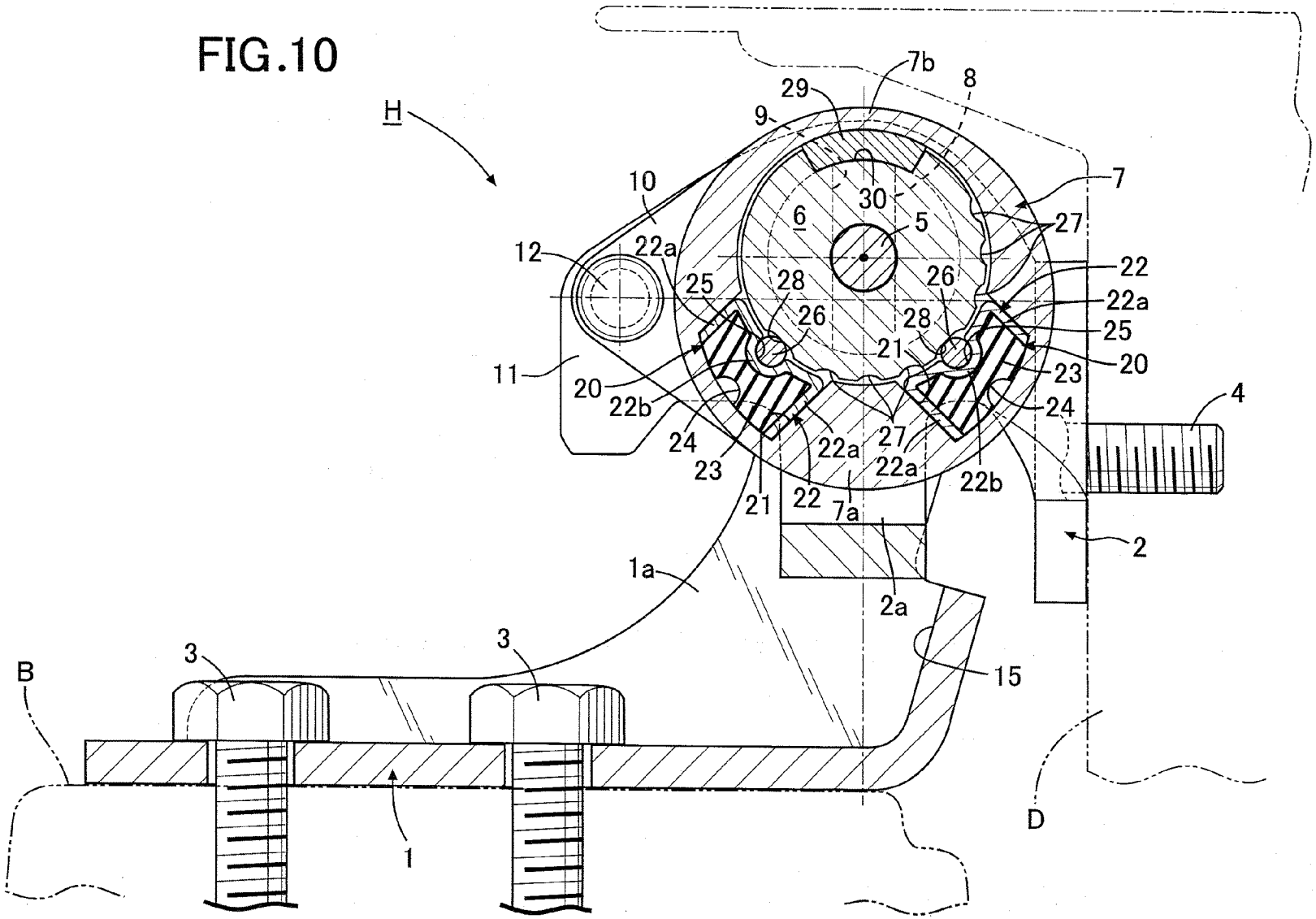
FIG. 10 is a view corresponding to FIG. 5 and showing a second embodiment of the present invention.

Next, a second embodiment of the present invention, which is shown in FIG. 10, will be described.

In the second embodiment, each of the holding members 22 provided respectively in the attachment concave portions 21 in the outer cylinder 7 is formed of a plate spring, and includes a pair of end wall portions 22*a* and a flexible connecting wall portion 22*b*. The end wall portions 22*a* are placed respectively on the inner walls, facing each other in the circumferential direction of the outer cylinder 7, of the attachment concave portion 21, while the connecting wall portion 22*b* integrally connect the end wall portions 22*a* to each other. A holding groove 25 for holding the detent roller 26 is formed in the connecting wall portion 22*b*, while the elastic member 23 made of rubber is filled in the attachment concave portion 21 so as to urge the connecting wall portion 22*b* towards the inner cylinder 6. Since the other configurations in the second embodiment are the same as those of the aforementioned embodiment, parts corresponding to those in the aforementioned embodiment will be denoted by the same reference numerals in FIG. 10, and overlapping descriptions therefor will be omitted.

In the second embodiment, the flexure of the connecting wall portion 22*b* allows the resilient force of the elastic members 23 to be transmitted to the detent rollers 26. This configuration makes it possible to eliminate the sliding portion between each holding member 22 and the corresponding attachment concave portion 21, thus preventing friction noise from being generated.

Figure 11:
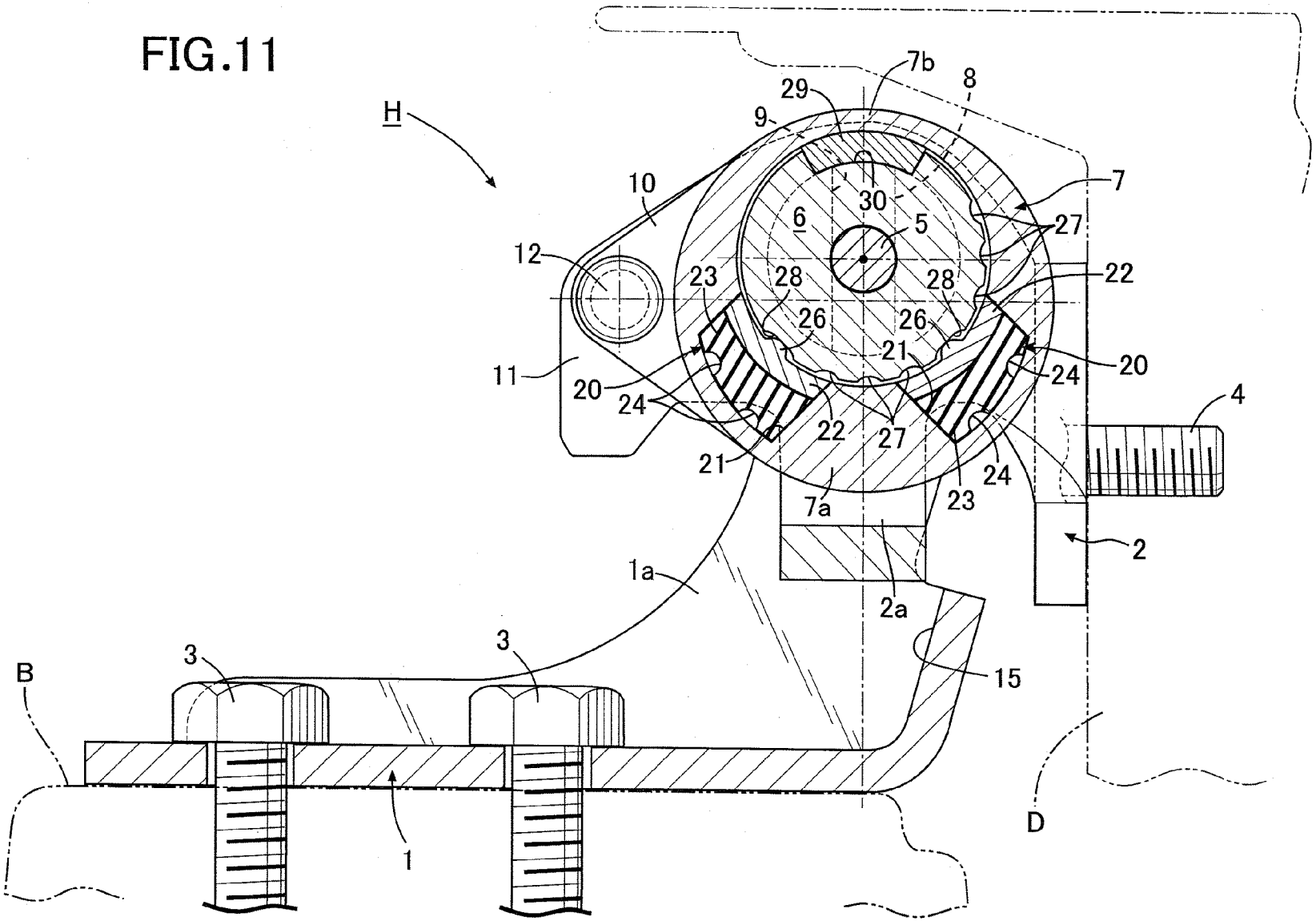
FIG. 11 is a view corresponding to FIG. 5 and showing a third embodiment of the present invention.

Lastly, a third embodiment of the present invention, which is shown in FIG. 11, will be described.

The third embodiment shows that a semi-columnar detent projection 26 extending in the axial direction of the outer cylinder 7 may be formed integrally on each holding member 22 in place of the detent roller 26 in each of the first and second embodiments. FIG. 11 shows a representative example of the third embodiment, in which the holding members 22 and the detent roller 26 in the first embodiment shown in FIG. 5 are modified. Since the other configurations in the third embodiment are the same as those of the first embodiment, parts corresponding to those in the first embodiment will be denoted by the same reference numerals in FIG. 11, and overlapping descriptions therefor will be omitted.

According to the third embodiment, the forming of the detent projection 26 integrally on each holding member 22 makes it possible to simplify the structure by reducing the number of components, and further to achieve reduction in cost.

The present invention is not limited to the above-described embodiments, and various modifications in design may be made thereon without departing from the gist of the invention. For example, the female bracket 1 may be fixed to the door D, and the male bracket 2 may be fixed to the body B. In addition, the hinge pin 5 and the inner cylinder 6 may be formed integrally with each other. Moreover, the checker-equipped door hinge device H may be employed as a hinge that supports a door for opening and closing a tailgate of a wagon-type vehicle. Furthermore, as the elastic members 23, one of a coil spring, a disc spring, a plate spring, and the like, each made of metal may be alternatively employed.

What is claimed is:

1. A checker-equipped door hinge device for a vehicle, comprising:

a first bracket fixed to one of a body and a door;

a second bracket fixed to another one of the body and the door;

a hinge pin connecting the first and second brackets to each other, and allowing the brackets to be relatively rotatable;

an inner cylinder connected integrally to the first bracket and disposed coaxially with the hinge pin;

an outer cylinder connected integrally to the second bracket and disposed so as to surround the inner cylinder in a manner of being rotatable relative to the inner cylinder, wherein longitudinal axial end faces of at least one of the inner and outer cylinders are parallel relative to an inner surface of the first and second brackets; and a plurality of checking-force generating mechanisms are arranged in a circumferential direction of the outer cylinder, are spaced angularly relative to each other, and provided between the inner cylinder and the outer cylinder, the checking-force generating mechanisms generating a checking force against the door at a predetermined opening position for the door, wherein an inner peripheral surface and an outer peripheral surface of the outer cylinder are eccentric to each other, so that a thick wall portion having a large distance between the inner peripheral surface and the outer peripheral surface is formed in the outer cylinder, and the checking-force generating mechanisms are provided in the thick wall portion of the outer cylinder.

2. The checker-equipped door hinge device according to claim 1, wherein an attachment concave portion opening towards an outer peripheral surface of the inner cylinder is provided in the thick wall portion, the checking-force generating mechanisms are each formed of: a holding member supported in the attachment concave portion so as to be capable of advancing and retreating with respect to the outer peripheral surface of the inner cylinder; and an elastic member housed in the attachment concave portion so as to urge the holding member towards the outer peripheral surface of the inner cylinder, a detent projection is provided on the holding member, the detent projection projecting to be abut against the outer peripheral surface of the inner cylinder, and a detent groove is provided in the outer peripheral surface of the inner cylinder, the detent projection being engaged with, and disengaged from, the detent groove in association with the relative rotations of the inner cylinder and the outer cylinder.

3. The checker-equipped door hinge device according to claim 2, further comprising a slider in the inner cylinder, the slider slidably abutting against the inner peripheral surface of a thin wall portion of the outer cylinder, the thin wall portion having a small distance between the inner peripheral surface and the outer peripheral surface.

* * * * *